United States Patent [19]

Bauder

[11] 4,170,204

[45] Oct. 9, 1979

[54] FUEL INJECTION SYSTEM

[75] Inventor: Armin Bauder, Neckarsulm, Fed. Rep. of Germany

[73] Assignee: Audi Nsu Auto Union Aktiengesellschaft, Fed. Rep. of Germany

[21] Appl. No.: 837,458

[22] Filed: Sep. 28, 1977

[30] Foreign Application Priority Data

Sep. 30, 1976 [DE] Fed. Rep. of Germany ..... 2644051

[51] Int. Cl.[2] ..... F02D 3/02

[52] U.S. Cl. ..... 123/139 AW; 123/139 AF; 261/39 A; 261/50 A

[58] Field of Search ..... 123/139 AW, 139 AF, 123/119 R; 261/50 A, 39 A

[56] References Cited

U.S. PATENT DOCUMENTS

| | | | |
|---|---|---|---|
| 2,683,418 | 7/1954 | Smith, Jr. | 123/139 AF |
| 2,809,022 | 10/1957 | Chandler | 261/39 A |
| 3,805,758 | 4/1974 | May | 123/139 AW |
| 3,809,036 | 5/1974 | Knapp et al. | 123/139 AW |
| 3,967,607 | 7/1976 | Eckert | 123/139 AW |
| 3,994,267 | 11/1976 | Eisele et al. | 123/139 AW |
| 4,018,200 | 4/1977 | Stumpp et al. | 123/139 AW |

*Primary Examiner*—Charles J. Myhre
*Assistant Examiner*—Andrew M. Dolinar
*Attorney, Agent, or Firm*—Kane, Dalsimer, Kane, Sullivan and Kurucz

[57] ABSTRACT

A fuel injection system is provided for a mixture-compressing spark-ignition internal combustion engine having continuous fuel injection into the engine intake manifold, and an adjustable throttle valve in the manifold. A flow sensing element in the intake manifold is arranged to move in accordance with the quantity of air flowing through the manifold to operate a fuel-metering valve for dispensing a quantity of fuel proportion to the quantity of air. A constant pressure valve is arranged to ensure a substantially constant pressure differential across the metering valve. The constant pressure valve has two chambers separated from each other by a movable partition element. A differential pressure regulating valve also has two chambers separated by a movable partition element. The first chamber has a constant pressure valve being subject to the pressure downstream of the metering valve and communicates with a fuel injection nozzle of the engine. The second chamber of the constant pressure valve communicates with the first chamber of the differential pressure regulating valve. The second chamber of the differential pressure regulating valve is subject to the pressure upstream of the metering valve. The two chambers of the constant pressure valve are connected to each other by a passage.

6 Claims, 4 Drawing Figures

V
s
a
b

FUEL INJECTION SYSTEM

BACKGROUND OF THE INVENTION

It has been proposed in the past to provide a fuel injection system for a mixture-compressing spark-ignition internal combustion engine with continuous fuel injection into the engine intake manifold and an adjustable throttle valve in the manifold. A flow sensing element in the intake manifold is arranged to move in accordance with the quantity of air flowing through the manifold, and to operate a fuel-metering valve for dispensing a quantity of fuel substantially proportional or related to the quantity of air. A constant pressure valve ensures a substantially constant pressure differential across the metering valve, and as two chambers separated from each other by a diaphragm or other movable partition element. A differential pressure regulating valve also has two chambers separated by a diaphragm or other movable partition element. The first chamber of the constant pressure valve is subject to the pressure downstream of the metering valve and communicates with a fuel injection nozzle of the engine through a valve aperture controlled by the associated diaphragm. The second chamber of the constant pressure valve communicates with the first chamber of the differential pressure regulating valve, which in turn communicates with a return line via a spring loaded valve which is controlled by the diaphragm of the differential pressure regulating valve. The second chamber of the differential pressure regulating valve is subject to the pressure upstream of the metering valve.

It will be appreciated by those skilled in the art that the differential pressure at the metering valve should be kept as low as possible, since the quantity of fuel dispensed to the fuel injection jet is the product of the differential pressure and the cross-section of the dispensing orifice and, for reasons of production technology, this cross-section must not fall below a specific size. However, a low differential pressure has the disadvantage that the quantity of fuel dispensed is influenced by the internal stresses of the diaphragm of the constant pressure valve, and in such case the resultant dispensing error makes it practically impossible to dispense a quantity of fuel proportional to the quantity of induced air.

SUMMARY OF THE INVENTION

Now it is an object of the present invention to provide an improved fuel injection system for mixture-compressing spark-ignition internal combustion engines having continuous injection into the air intake manifold with better control on the quantity of fuel dispensed.

In accordance with the invention the two chambers of the constant pressure valve are connected to each other by a passage, which can be adjusted if necessary, and thus the effect of the internal stresses in the diaphragm of the constant pressure valve on the quantity of fuel dispensed is diminished so that substantial proportionality is achieved between the quantity of air drawn in and the quantity of fuel dispensed.

In a fuel injection system according to the invention, the fuel flowing through the second chamber of the constant pressure valve is branched off downstream of the metering valve. In consequence, the quantity of fuel dispensed by the metering valve is composed of the fraction of fuel fed to the injection jet and the fraction of fuel flowing through the passage into the second chamber of the constant pressure valve. If the quantity of fuel injected remains constant the differential pressure can be increased. Doubling the differential pressure, for example from 0.1 to 0.2 bars, produces a reduction of up to 10% in the dispensing error. A further advantage which is achieved by increasing the differential pressure resides in that effects of fluid friction against the aperture of the metering valve are minimized, so that particularly for idling and for lower end partial load operation, where the cross-section of the metering valve is very small, a more accurate dispensing of fuel is achieved. Finally, by virtue of the passage between the chambers of the constant pressure valve, a substantially better venting of the valve chambers is achieved and the risk of vapor bubbling is diminished. The cross-section of the passage is preferably adjustable so that in injection systems having a plurality of injection jets, each of which has a constant pressure valve associated with it, it becomes possible to equate the quantity of fuel to the constant pressure valves and thus further reduce the dispensing error.

The invention may be performed in various ways and one specific embodiment will now be described with some possible modifications by way of example with reference to the accompanying drawings.

DETAILED DESCRIPTION

Figures 1, 2:
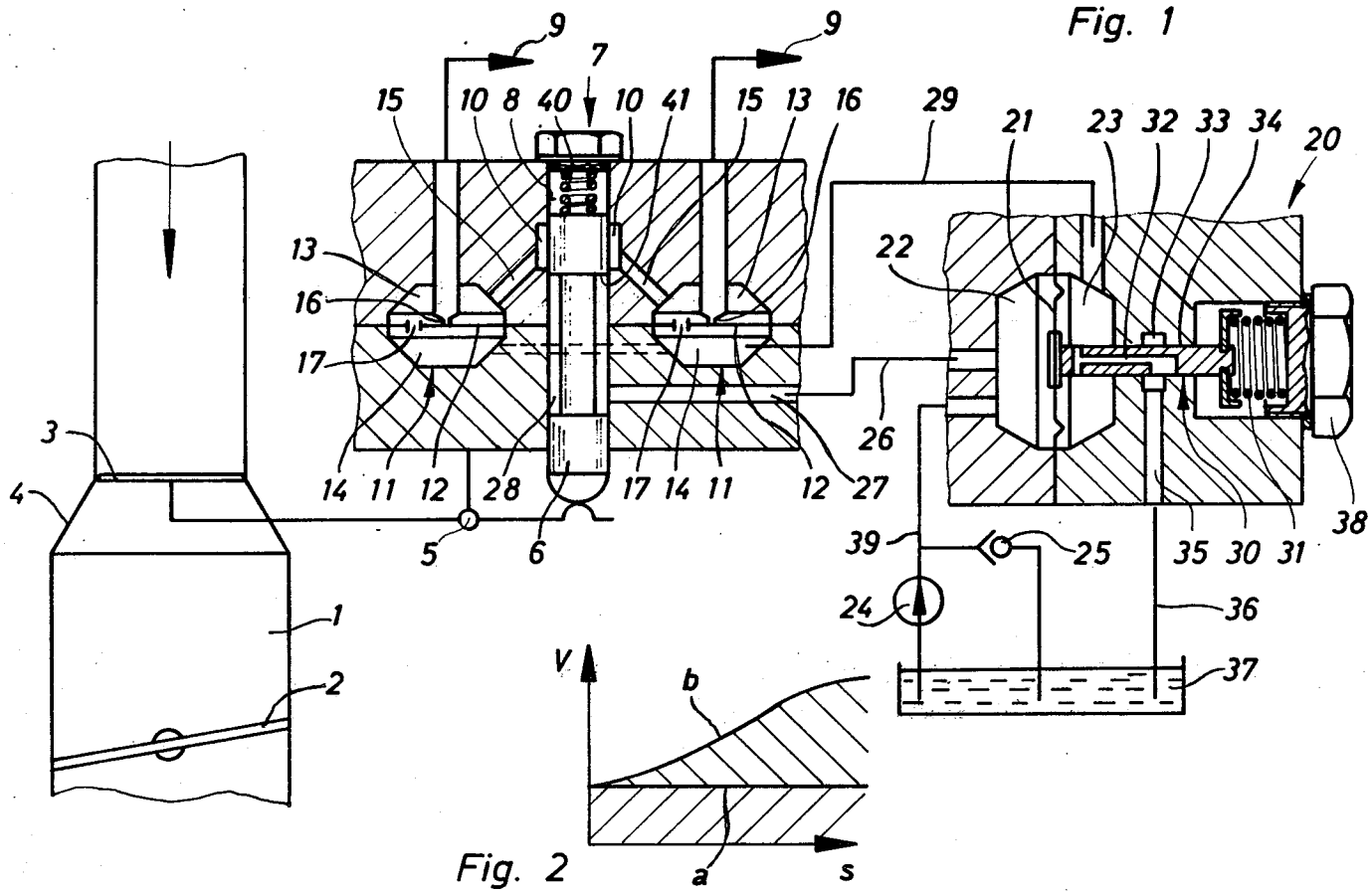
FIG. 1 is a diagrammatic view, partly in section of a fuel injection system according to the invention.
FIG. 2 is a diagram illustrating the breakdown of the quantity of fuel dispensed.

Referring first to the example illustrated in FIG. 1, reference numeral 1 denotes an intake duct of a mixture compressing spark-ignition internal combustion engine, having an arbitrarily operable throttle valve 2 and a measuring element 3 adapted to move in accordance with the quantity of air flowing through in the direction of the arrow. The measuring element 3 is constructed in the form of a baffle plate and is disposed in a conical portion 4 of the intake duct. The baffle plate 3 is pivotally mounted at 5 and acts on the displaceable control piston 6 of a fuel-metering valve 7. The control piston 6 is located in a cylindrical bore 8, in the wall of which there are a number of control slots 10 corresponding to the number of injection jets 9 indicated by arrows. Downstream of each control slot 10 is a constant pressure valve 11 having two chambers 13 and 14 separated from each other by a diaphragm 12. Each chamber 13 communicates through a passage 15 with the relevant control slot 10 and through a valve aperture 16 controlled by the diaphragm 12, with the injection jet 9. The second chamber 14 of each constant pressure valve 11 is connected to the first chamber 13 via a by-pass aperture 17 provided in the diaphragm 12.

The fuel injection system also includes a differential pressure regulating valve 20 having two chambers 22 and 23 separated from each other by a diaphragm 21. Fuel is fed to the chamber 22 by an electrically driven fuel pump 24 and at the pressure obtaining in the system, the pressure being determined by a system pressure maintaining valve 25. The chamber 22 furthermore communicates through a line 26 and a passage 27 with an annular groove 28 in the control piston 6 of the fuel-metering valve 7. The second chamber 23 of the differential pressure regulating valve 20 is connected to the second chamber 14 of all the constant pressure valves 11 by a line 29. The pressure in the chamber 23 which determines the differential pressure at the metering valve 7 is regulated by a valve member 30, which under the action of a spring 31, is pressed against the diaphragm 21 of the differential pressure regulating valve 20 and which has communicating with the chamber 23 a bore 32 which, according to the position of the valve member 30, is more or less connected to an annular groove 33 in the wall of the bore 34 which receives the valve member 30. The annular groove 33 communicates with the fuel tank 37 through a passage 35 and a return line 36. The initial stress in the spring 31, which can be set by a screw 38, determines the magnitude of the differential pressure at the metering valve 7.

The fuel delivered by the fuel pump 24 passes through the line 39 into the first chamber 22 of the differential pressure regulating valve 20 and then through the line 26 and the passage 27 into the annular groove 28 of the control piston 6. The control piston 6 is displaced upwardly from the inoperative position as illustrated by the baffle plate 3, according to the amount by which it is deflected by the quantity of air passing through the intake pipe 1, and against a counteracting force which in this illustrated embodiment is provided by a spring 40, the control edge 41 exposing the control slots 10 to a greater or lesser extent in proportion to the deflection of the baffle plate 3. The fuel can then pass through the passages 15 into the first chambers 13 of the constant pressure valves 11, where it is divided into two partial flows. The first partial flow passes through the aperture 17 into the second chamber 14 of each constant pressure valve 11 and the second partial flow can flow through the valve aperture 16 to the associated injection jet 9.

By virtue of the fact that not only the quantity of fuel which has to be fed to the injection nozzles 9 is conveyed through the control slots 10 of the metering valve 7, but also the quantity of fuel flowing through the apertures 17 into the second chambers 14 of the constant pressure valve 11, so the differential pressure can be increased without increasing the quantity of fuel which is fed to the injection nozzles 9. As a result, the effect of the inherent behavior of the diaphragm 12 on the quantity of fuel fed to the injection nozzle 9 is reduced, resulting in better proportionality between the drawn-in quantity of air and the quantity of fuel dispensed. The magnitude of the differential pressure is, as previously mentioned, determined by the initial stress in the spring 31 in the differential pressure regulating valve 20. In order to achieve a variation in the differential pressure as a function of specific operating conditions, so the initial stress in the spring 31 can be varied by the screw 38 or other means not shown. An increase in the initial spring stress according to the position of the throttle valve 2 for example permits of fuel enrichment under full load. Fuel enrichment during cold starting can be achieved by increasing the initial stress in the spring 31 according to the engine temperature. By providing a barometer capsule which acts on the spring 31, it is a simple matter to provide for the air pressure to influence the quantity of fuel.

The diagram in FIG. 2 shows the breakdown of the quantity of fuel in each constant pressure valve 11 which is dispensed by the metering valve 7. In the diagram, V is the quantity of fuel dispensed by the metering valve 7 and S is the displacement of the control piston 6 of the metering valve 7. The straight line 'a' represents the ever-constant quantity of fuel flowing through the aperture 17 into the second chamber 14 of the constant pressure valve 11 while the curve 'b' represents the quantity of fuel fed to the injection jet 9.

Figure 4:
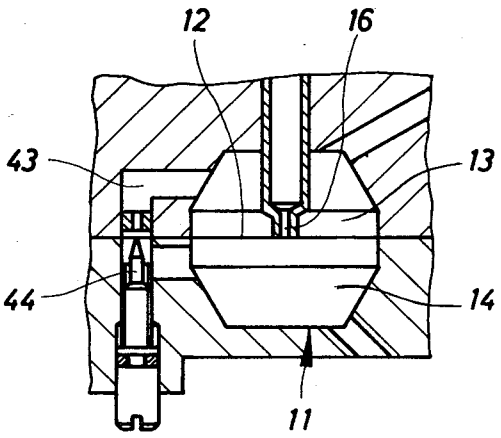
FIG. 4 is another sectional view illustrating the location of an adjustable aperture in a constant pressure valve of another embodiment.
Figure 3:
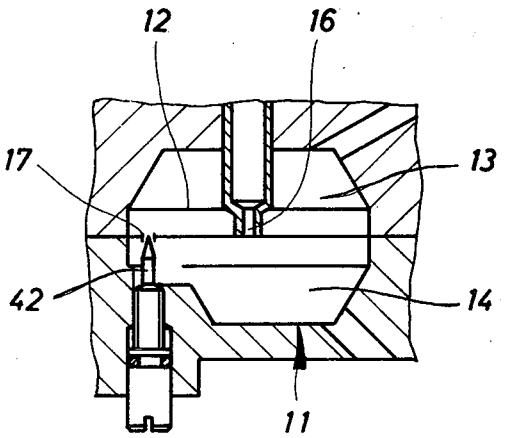
FIG. 3 is a sectional view illustrating the location of an adjustable aperture in a constant pressure valve of one embodiment.

In order to equalize the quantities of fuel at all constant pressure valves 11, it is expedient to make the aperture 17 between the two chambers 13 and 14 of each constant pressure valve 11 adjustable. FIGS. 3 and 4 show two possible ways of achieving such adjustment. In FIG. 3, the aperture 17 is disposed in the non-moving portion of the diaphragm 12 and cooperates with a valve needle 42 disposed in adjustable fashion in the housing of the metering valve 7. In the case of the embodiment shown in FIG. 4, the passage between the chambers 13 and 14 is constituted by, disposed in the housing of the metering valve 7, a passage 43, the cross-section of which can in turn be adjusted by a longitudinally displaceable valve needle 44.

Of course, many modifications of the example of embodiment illustrated are possible without departing from the framework of the invention. The baffle plate 3 can, for example, be replaced by a per se known flap mounted to rotate at the edge of the intake pipe and instead of a lineraly displaceable control piston, the metering valve 7 may have a rotary slide coupled to the spindle of the baffle plate.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. In a fuel injection system for a mixture-compressing spark ignition internal combustion engine including an intake manifold having continuous fuel injection into the engine intake manifold, comprising a source of pressurized fuel, a fuel injection nozzle, an adjustable throttle valve in the manifold, a flow sensing element in the intake manifold arranged to move in accordance with the quantity of air flowing through the manifold, a fuel-metering valve operated by said flow sensing element for dispensing a quantity of fuel related to the quantity of air to said nozzle, a constant pressure valve arranged to ensure a substantially constant pressure differential across the metering valve, and a differential pressure regulating valve, each of said constant pressure valve and differential pressure regulating valve having a first and second chambers and a movable partition element separating said chambers from each other, first and second means for communicating the first chamber of the constant pressure valve via said metering valve with said source and with said nozzle respectively, third and fourth means for communicating the first chamber of the differential pressure regulating valve with the second chamber of the constant pressure valve and with a return line respectively, said fourth means including a spring-loaded valve controlled by the movable partition element of the differential pressure regulating element and means for communicating the second chamber of the differential pressure regulating valve to the pressure upstream of the metering valve, the improvement being that a passage is included for directly connecting the two chambers of the constant pressure valve to each other.

2. A fuel injection system according to claim 1, in which the passage is formed by an aperture in the partition element of the constant pressure valve.

3. A fuel injection system according to claim 1, in which the constant pressure valve includes a housing and the passage is formed in said housing.

4. A fuel injection system according to claim 1, in which the cross-section of the passage is adjustable by a movable jet control needle.

5. A fuel injection system according to claim 1, in which at least one of the partition elements is a diaphragm.

6. A fuel injection system according to claim 1, in which the first chamber of the constant pressure valve communicates with a fuel injection nozzle of the engine through a valve aperature controlled by the associated movable partition element.

* * * * *